United States Patent [19]

Wiebe

[11] 4,159,458

[45] Jun. 26, 1979

[54] ENCAPSULATED ELECTRICALLY CONDUCTING COMPONENT WITH RESERVOIR END CAPS

[76] Inventor: Gerald L. Wiebe, 18 W. 077 Williamsburg La., Villa Park, Ill. 60181

[21] Appl. No.: 820,724

[22] Filed: Aug. 1, 1977

[51] Int. Cl.[2] ..... H01H 85/16

[52] U.S. Cl. ..... 337/252; 337/232; 338/274; 338/329

[58] Field of Search ..... 337/252, 251, 248, 231, 337/232, 236, 260, 262; 338/274, 329, 272, 332, 313; 29/619, 621, 623

[56] References Cited

U.S. PATENT DOCUMENTS

| | | | |
|---|---|---|---|
| 1,278,911 | 9/1918 | Griffith | 337/232 |
| 2,532,078 | 11/1950 | Baxter | 337/231 |
| 2,876,312 | 3/1959 | Frederick | 29/623 |
| 3,914,863 | 10/1975 | Wiebe | 29/623 |

*Primary Examiner*—Harold Broome

[57] ABSTRACT

A component and method for applying end caps thereto is provided. A wire extends within a body defining a body sidewall and oppositely facing body ends with opposite end portions of the wire extending outwardly beyond the body ends and bent over so that they lie adjacent to each end of the body. Two end caps are provided, each having a cylindrical first portion and a cylindrical second portion with a diameter less than the first portion and joined to the first portion by an annular shoulder. The cylindrical second portion has an end wall so that the second portion defines a chamber. A solder and flux mixture is deposited in the chambers of the end caps which are then each applied to an end portion of the body with the cylindrical first portion compressively embracing the sidewall of the body adjacent one end thereof. The shoulder of the end cap bears against the body end to maintain the end wall of the cap at a predetermined distance from the body end and thereby prevent severance of the wire end portion. Heat is applied to each end cap to melt the mixture so that it flows around the wire end portion to form a solder bond between the end portion and the end cap.

29 Claims, 4 Drawing Figures

ENCAPSULATED ELECTRICALLY CONDUCTING COMPONENT WITH RESERVOIR END CAPS

BACKGROUND OF THE INVENTION

The present invention relates in general to electrically conducting components and more particularly to automotive and appliance type protective fuses which have a fusible link element encapsulated in a thermoplastic material.

In the U.S. Pat. No. 3,832,664 issued to the inventor of the present invention, a fuse is disclosed in which an elongate wire-like fusible link element is disposed within a generally cylindrical thermoplastic body having oppositely facing body ends. End portions of the wire-like fusible element extend outwardly beyond the ends of the body and are bent over at an angle so that they lie generally adjacent and parallel to the body ends. Generally cup-shaped end caps are positioned on the fuse body and the angled end portions of the wire-like fusible element are compressed between the opposed end surfaces of the fuse body and the end walls of the end caps. This provides a positive electrical connection between the wire-like element.

Electrical conducting components for fuses having a structure similar to that disclosed in the above-described U.S. Pat. No. 3,832,664 offer a number of advantages of structure and of ease of manufacture. However, with certain methods of manufacture, involving certain types of fabricating apparatus operated at very high speeds on a production line basis, it is possible to force the end caps against the fuse body ends with an excessive amount of force so that the bent over portions of the wire-like element are pushed against the fuse body ends with an undesirably high amount of force which can cause the wire-like element end portions to be severed from the main portion of the element embedded in the thermoplastic body. Obviously, such severance can partially or totally destroy the electrically conductive path between the end caps.

It would be desirable to provide an electrically conducting component which would offer the many advantages, including simplicity and ease of manufacture, of the fuse disclosed in the above-described U.S. Pat. No. 3,832,664. It would be desirable to provide a structure which would allow manufacture of an electric conducting component using electrically conducting end caps which could be manufactured using very high speed end cap applying apparatus so that the possibility of severing the bent over wire-like fusible link or other conducting element end portions upon application of the end caps is substantially reduced or totally eliminated.

Though the fuses of the type disclosed in the above-described U.S. Pat. No. 3,832,664 function well, and as intended, when properly made in accordance with the teachings of the specification of that patent, with certain high speed manufacturing processes and with certain high speed apparatus used to effect such manufacturing processes. It is possible that the end caps may not always be applied to the fuse body ends to achieve the positive electrical connection structure disclosed in the patent. Specifically if the end caps are not fully inserted onto the fuse body ends, the bent over end portions of the wire-like element may engage the end wall of the end caps at only one point, or at only a few points, of contact. This may result in very poor electrical conductivity between the end caps and the wire-like fusible element.

With certain types of high speed end cap applying apparatus, the end caps are first initially moved axially against the fuse body ends to bend the end portions of the wire-like element toward or against the fuse body ends. Subsequently, the end caps may be crimped onto the fuse body and the apparatus is withdrawn while the end caps remain on the fuse body ends. If the high speed end cap applying apparatus is not functioning properly, or under certain impact rebound conditions, the end caps, after being moved onto the fuse body ends by the apparatus, may be accidentally pulled some amount outwardly from complete engagement with the fuse body ends. An end cap may be pulled out a sufficient amount so that there is no longer any electrical contact between the bent over end portion of the wire-like element and the end wall of the end cap. In such cases, there will be no electrically conducting path between the two opposed end caps on the fuse body.

It would be desirable to provide an end cap structure which would allow the placement of an electrically conductive fluid material within the end cap structure and surrounding bent over end portion of a wire-like element so that the electrical conductance between the end cap and the wire-like element would be improved and so that, even if the bent over end portion was not in direct physical contact with the end wall of the end cap, electrical conduction would be possible between the end cap and the element by virtue of the electrically conducting material filling the voids between the element end portion and the end cap.

One of the important design characteristics of an electrically conducting component, including fuses, is the internal resistance of that component. In many cases, it is desirable that the internal resistance be either as low as possible or maintained at some specific, predetermined amount. With electrically conducting components which have internal connections, the total internal resistance of that component includes the so-called contact resistances which are present at each internal connection or contact point. In order to reduce contact resistances, it is generally desirable to provide a component that has very low internal contact resistances. With respect to a fuse of the type described above which has a wire-like fuse element and end caps on each end of the fusible element, it is desirable to provide an electrically conducting path between the end portion of the wire-like fusible element and the end cap which has a very low contact resistance.

It would be advantageous in many cases to apply an electrically conducting material to the inside of the end cap to improve electrical conduction between the fusible element and the end cap. The material, such as solder, could conveniently be heated to form a fluid and allowed to flow around the fusible element end portion in the end cap. If this were done with the type of end cap structure disclosed in the above-described U.S. Pat. No. 3,832,644, certain problems could arise.

Specifically before applying the end caps to the fuse body, a drop of liquid solder or other electrically conducting material would be deposited in end caps. Before the next step could be effected, the solder would cool and solidify. Subsequently, the end caps would be placed over the fuse body ends and heat would be applied to the end caps to remelt the solder so that it would flow around the bent over end portion of the wire-like element and form an electrically conducting connection between the end cap and the wire-like element. If the end wall of the end cap were relatively close to the fuse body end, much of the heat applied to the end cap would be conducted to the fuse body end and might partially melt or otherwise degrade the fuse body material. Further, if a relatively high-melting point solder were used, the application of heat to the end caps might cause partial melting of the bent over end portion of the wire-like element.

In any case, it would be necessary to carefully control the heating of the end cap to effect the remelting of the solder without melting or damaging the wire-like element and/or the fuse body. Consequently, it would be desirable to provide a structure for receiving a solder or electrically conducting fluid material, which structure would allow heating of the end cap to effect remelting of the fluid material without conducting or transmitting a significant portion of the applied heat to the fuse body or bent over end portion of the wire-like element.

In providing a solder-type one cap connection, appropriate cleaning and fluxing of the end cap and fuse element end portion is required in order to provide a proper solder bond of high integrity and low electrical resistance. It would be desirable to provide an end cap structure wherein a separate cleaning and fluxing operation need not be performed on the fuse wire prior to applying the end cap to the fuse body.

In providing a structure for receiving an electrically conducting fluid material for surrounding the bent over end portion of the wire-like element and for providing an electrically conducting path between the end portion and an end cap, it would also be desirable to provide a structure which prevents the electrically conducting fluid material from flowing out of the structure and alongside the exterior portion of the body of the component.

SUMMARY OF THE INVENTION

The present invention provides an extremely simplified structure employing end caps with a novel component end abutment and electrically conducting material chamber.

Specifically, in the preferred embodiment of the present invention, the electrically conducting component is a fuse having a generally cylindrical, solid unitary body of thermoplastic material defining a body sidewall and oppositely facing body ends. An elongate wire-like fusible link formed from a low-melting point metal alloy is embedded in situ in the fuse body with opposite end portions of the fusible link extending outwardly beyond the end of the fuse body. The end portions of the wire-like fusible link element are positioned at an angle with respect to the length of the element within the body so as to be disposed adjacent the respective body ends.

A metal end cap is positioned over each end portion of the body. Each end cap has a cylindrical first portion and a cylindrical second portion with a diameter smaller than the first portion and joined to the first portion by an annular shoulder. The end cap further has an end wall at one end of the cylindrical second portion. The inside surface of the cylindrical first portion embraces the sidewall of the body adjacent one end thereof and the end wall of the end cap is disposed adjacent the end of the fuse body with the annular shoulder bearing against the fuse body end in direct contact therewith whereby severence of the end portion of the wire-like fuse element by the end wall of the end cap is prevented by the annular shoulder which serves to maintain the end wall at a predetermined distance from the fuse body end.

The cylindrical second portion, in cooperation with the fuse body end, defines a chamber for receiving an electrically conducting material to improve the electrical conductance between the end cap and the wire-like fuse element.

According to the method of the present invention, an end cap is applied to the body of a component in a manner that effects good electrical contact between the end cap and a conductor end portion extending from the body. The method eliminates the need for a separate cleaning and/or fluxing of the conductor end portion before applying the end cap. Specifically, a liquid mixture of solder and flux is provided in the end cap chamber. Preferably the mixture is deposited as a liquid drop of flux core solder and is allowed to cool. The end cap is then applied to the component body end with the shoulder bearing against the body end and with the conductor end portion projecting into the chamber. Heat is applied to the end cap to remelt the mixture so that it flows around the conductor end portion to form a solder bond between the end portion and the end cap.

Numerous other advantages and features of the present invention will become readily apparent from the following detailed description of the invention and of one embodiment thereof, from the claims and from the accompanying drawings.

BRIEF DESCRIPTION OF THE DRAWINGS

In the accompanying drawings forming part of the specification, and in which like numerals are employed to designate like parts throughout the same.

DESCRIPTION OF THE PREFERRED EMBODIMENT

Figure 1:
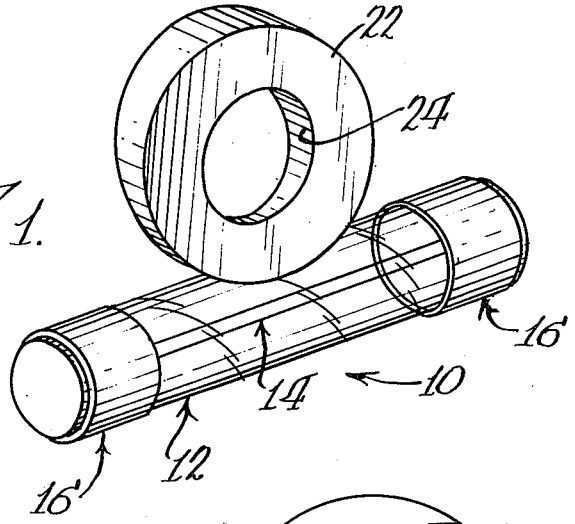
FIG. 1 is a perspective view of a fuse formed in accordance with the teachings of the present invention.

While the apparatus of the invention is susceptible of embodiment in many different forms, there is shown in the drawings and will herein be described in detail one specific embodiment with the understanding that the present disclosure is to be considered as an exemplification of the principles of the invention and is not intended to limit the invention to the embodiment illustrated.

The precise shapes and sizes of the components herein described are not essential to the invention unless otherwise indicated, since the invention is described with only reference to an embodiment which is simple and straightforward.

Referring now to the drawings, the electrically conducting component of the present invention is shown, in a preferred embodiment as a fuse, in its entirety at 10 in FIG. 1, and includes a body 12, a fusible link 14, and end caps 16.

Figure 2:
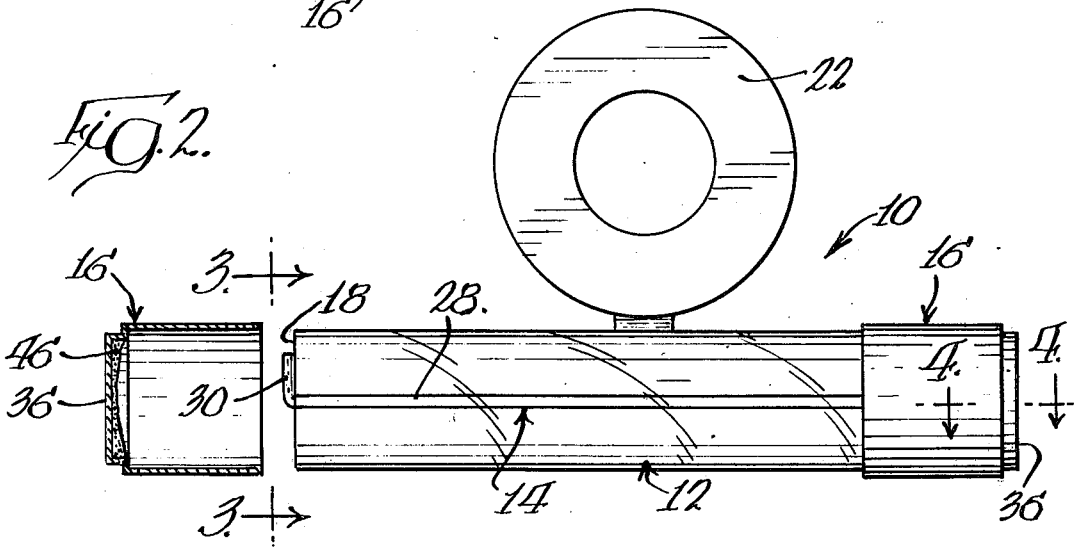
FIG. 2 is a side elevational view, partially in cross section and partially exploded.

In the illustrated embodiment, body 12 is a solid, unitary, generally cylindrically-shaped member having flat, parallel, opposite end surfaces 18 as best illustrated in FIG. 2 for the left-hand end portion of the fuse. The body 12 is preferably formed by a molding process with the fusible link 14 having been previously placed in the cavity of the mold, so as to be positioned centrally within the body 12. The body 12 is preferably formed from a clear plastic material, such as the thermoplastic polycarbonate resin sold by General Electric Company under the trademark LEXAN. Other clear, tough, heat-resistant, dimensionally stable, non-conductive plastic materials may also be used, such as high impact polystrene cellulose propionate, cellulose acetate-butyrate, etc., While thermoplastic materials are preferred, the present invention contemplates that certain thermosetting materials may be used. The particular plastic material that is utilized is selected so that its properties, in combination with the properties of the fusible link, give the resulting fuse the desired rating and performance characteristics.

While body 12 is generally cylindrically shaped, as previously described, a gripping handle 22 is preferably formed integrally with the body to facilitate insertion and removal of the fuse in a fuse holdng clip structure, not shown. Handle 22 may be provided with an opening 24, so that the fuse may be readily carried (or displayed) on a key chain, or the like. The generally cylindrical configuration is preferred, although it is contemplated that the fuse body may be other than circular in cross section, e.g., oval, square, hexagonal, etc. In all fuse bodies, it is desired that at least the end portion thereof be circular in cross section, so as to readily accept conventional end caps, as will hereinafter appear. The fusible link 14 is in the form of an elongate wire, which in the illustrated embodiment is circular in cross section and centered relative to body 12, as previously mentioned. The external surface of the major portion 28 of the fusible link (FIG. 2), which is embedded in situ in body 12 by virtue of the molding operation, is in intimate surface-to-surface contact with the thermoplastic body 12.

The wire 14 is preferably, although not necessarily, a low-melting point alloy such as, for example, an alloy consisting essentially of from about 95 percent tin to about 5 percent lead. The present invention contemplates the use of fusible link wires 14 having diameters of between 0.010 and 0.050 inch, depending on the current rating of the fuse. While low-melting point alloys are preferred, the present invention also contemplates that the fusible link may be formed of copper, steel, or aluminum, although with such metals, a very fine filament must be used. While the wire 14 has been illustrated as being circular in cross section throughout its length, for certain applications it may be desirable to give the wire a different configuration, as by flattening the midportion thereof, as will be understood by those skilled in the art. In addition to flattening, the present invention contemplates that other operations, such as trimming, punching, stretching, etc., may be performed on the fusible link. Of course, if the wire is given a special configuration, this must be done prior to the molding operation.

Figure 3:
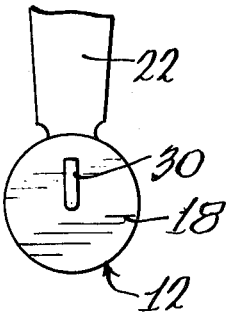
FIG. 3 is an end view of the left-hand end of the fuse taken generally along the plane 3—3 in FIG. 2.
Figure 4:
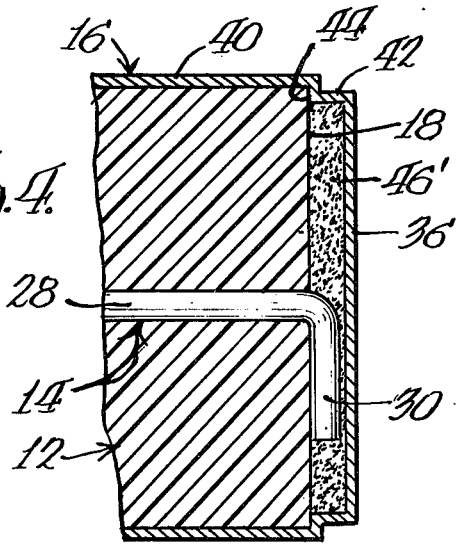
FIG. 4 is an enlarged, fragmentary, cross-sectional view of the right-hand end of the fuse taken generally along the plane 4—4 in FIG. 2.

Referring particularly to FIGS. 2, 3, and 4, it will be noted that the wire 14 has end portions 30 which are bent, angled, or otherwise shaped, to lie out of alignment with the major portion 28 of the fusible link 14. In the embodiment illustrated, the end portions 30 are bent at a substantially right angle to the major portion 28 of the fusible link 14 so that they lie parallel and adjacent to the end surface 18 of the fuse body 12. However, it is to be realized that other end portion configurations are possible, such as the coiled configuration disclosed in the previously discussed U.S. Pat. No. 3,832,664 and illustrated in FIG. 3 of that patent.

The fuse of the present invention is typically manufactured by extending a single elongate fuse wire 14 between a plurality of cavities of a multi-cavity mold. A plastic material of the above-described type is then simultaneously injected into each of the cavities while the wire is simultaneously retained in centered relationship with respect to the cavities, to form the fuse bodies 12. Subsequent to the molding operation, the outwardly projecting end portions 30 of the wire 14, which were formerly positioned between the mold cavities, are severed to provide wire end portions 30. The end portions are then bent in the illustrated configuration to provide for improved electrical contact and thermal conduction between the fusible link 14 and the end caps 16 when the end caps 16 are subsequently placed on the fuse body ends.

Alternatively, the ends 30 of the fusible link 14 may be left extending generally outwardly from the fuse body 12 and substantially perpendicular to the fuse body end surface 18. Then the end caps 16 are assembled to the body 12 by axial relative movement therebetween. Each end cap 16 has an end wall 36 which, when an end cap 16 is moved onto the end of the fuse body 12, engages the end 30 of the fusible link 14 and causes it to bend over toward or against the fuse body end surface 18 in the orientation illustrated in FIGS. 2, 3, and 4. The end portion 30 need not lie directly flat against the end surface 18 but may be angled outwardly with respect thereto.

In order to accommodate high-speed manufacturing of the fuse of the present invention with end cap applying apparatus which may not always be properly adjusted, a novel end cap structure is provided to prevent severing of the end portion 30 of the fuse wire 14 and to provide a reservoir for an electrically conducting fluid material to improve electrical conductance between the end cap 16 and the element 14. Specifically, each end cap is a cup-shaped element that includes, in addition to the end wall 36, a sidewall comprising a first cylindrical portion 40 and a second cylindrical portion 42 having a diameter less than the first portion and joined to the first portion by an annular shoulder 44. The inside surface of the sidewall, and specifically the inside surface of the first cylindrical portion 40, is adapted to compressively engage or embrace the sidewall of the fuse body 12 adjacent the end to which the cap 16 is applied.

The cap 16 is inserted onto the end of the fuse body 12 until the annular shoulder 44 bears against the fuse body end surface 18 in direct contact therewith. In this manner, the annular shoulder 44 acts as an abutment means to prevent the end cap from being pushed onto the end of the fuse body 12 by more than a certain amount. This serves to maintain the end wall 36 at a predetermined distance from the fuse body end surface 18.

With certain types of small diameter fuse wires 14, and with certain types of end cap applying apparatus operated at high speeds, the tendency to push the end caps 16 against the end surface 18 of the fuse body 12 with sufficient force to sever the end portion 30 of the fuse wire 14 is thus accommodated. That is, if the length of the second cylindrical portion 42 is made equal to, or slightly greater than, the diameter of the end portion 30, the end portion 30 cannot be compressively engaged between the fuse body end surface 18 and the end cap end wall 36 with sufficient force to sever the end portion 30 from the major portion 28 of the fusible link wire 14. Thus, high speed end cap applying apparatus can be used even though they tend to force the end cap 16 onto the ends of the fuse body 12 with an undue amount of force. Thus, the need for maintaining such end cap applying apparatus in a carefully calibrated operating condition is substantially reduced or eliminated.

The second cylindrical portion 42 forms a reservoir or chamber for receiving an electrically conducting material such as an eutectic metal alloy 46 as illustrated in FIG. 2. The electrically conducting material 46 may be an electrically conducting solder or other suitable material, such as a solder paint or other conductive paint. Solder, comprising 66⅔ parts by weight of tin and 33⅓ parts by weight of lead is preferably used as the electrically conducting material 46. The electrically conducting material 46 is deposited as a solid, generally cylindrical charge of flux core solder (about 0.062 inch in diameter and 0.125 inch in length) or as a liquid drop into an end cap 16 when the end cap is in a vertical position with the end wall 36 at the bottom. When a solid charge of material 46 is used, the end cap 16 may be pre-heated or may be subsequently heated to cause the material to flow over the inner surfaces of the end cap. Preferably, a predetermined amount of solder 46 is deposited so that about 85% of the volume of the reservoir in the end cap 16 is filled. The solder 46 rapidly cools and solidifies with a generally concave surface as illustrated in the end cap 16 on the left hand end of the fuse body 12 in FIG. 2. The end cap 16 is subsequently placed on the fuse body and the end cap is heated to remelt the solder 46 around the wire-like fuse element end portions 30.

The electrically conducting material or solder 46 improves electrical conductance between the end caps 16 and the wire-like fuse element 14. Specifically, if the end wall 36 of the end cap is spaced outwardly of the bent over end portion 30 of the fusible link 14 so that it is not in contact therewith as illustrated in FIG. 4, the remelted electrically conducting material or remelted solder 46′ serves to provide an electrically conducting path between the fuse link end portion 30 and the end cap 16. This is especially advantageous when using high speed end cap applying machines which may, owing to improper calibration or impact rebound, tend to pull the end cap 16 slightly away from the fuse body end 18 after initially placing the end cap 16 thereon.

Preferably, the solder is used with a flux in the form of a flux core solder. Typically, after the solder is deposited as a drop of liquid in the end cap 16 or as a solid charge of flux core solder in a pre-heated or subsequently heated end cap 16, much of the flux in the solder rises to the surface of the drop and forms a layer or coating of flux over the entire concave surface of the solder within the reservoir of the end cap 16. Both of the solder per se and the flux layer on top of the solder cool and solidify very rapidly and before any subsequent steps in the manufacturing process can be undertaken. After the end cap 16 has been properly placed upon the fuse body end, heat is applied to the end cap 16 to effect a remelting of the solder to cause the solder to flow between and around the end cap end wall 36, the fuse body end surface 18, and the fuse link end portion 30.

With some types of solder, a high temperature may be required to remelt the solder than was required to first melt the solder originally. This may be because of the creation of the flux coating on the surface of the solder deposit in the end cap or because of other changes within the solder brought about by the first application of heat. In any case, when the remelted solder 46′ flows around the fusible link end portion 30, it is desirable that the temperature of the liquid solder be less than the temperature required to melt the fusible link end portion 30. Preferably, the remelting temperature of the solder should be between 80° and 100° F. less than the melting temperature of the fuse link end portion 30.

Owing to the fact that the end wall is displaced outwardly a predetermined distance from the fuse body end surface 18 by annular shoulder 44, heat that is applied to the end cap end wall 36 is conducted through the end wall and to the drop of solder with very little of the heat being conducted to the fuse body end surface 18 and fuse link end portion 30. Most of the heat is conducted through the end cap end wall 36 to the solder drop which acts as a heat sink. The temperature of the solder drop is then raised above its melting point so that it becomes liquid.

In practice, it has been found that with appropriate application of heat to the end caps for a very short period of time, as by resistance heating, the surface coating of the flux on the solder deposit within the end cap 16 becomes liquid slightly sooner than, or at least at the same time as, the solder beneath it. In any case, the flux coating on the surface of the solder deposit is so quickly and sufficiently heated that it is violently agitated against the fuse link end portion 30 so that it effectively cleans and coats the fuse link end portion 30. By the time the fuse link end portion 30 has been cleaned and coated with the flux, the solder deposit has remelted and has also been sufficiently heated to become violently agitated so that it flows throughout all portions of the chamber defined by the end cap 16 and the fuse body end surface 18. The liquid solder then wets, and bonds to, all the surfaces cleaned by the flux — especially the fuse link end portion 30. Thus, any time consuming and expensive requirement for separately cleaning and fluxing the fuse link end portion 30 is eliminated. Since relatively little heat is transmitted directly to the fuse link end porton 30 and the fuse body end surface 18, the likelihood of the melting of the fuse link end portion 30 and the fuse body material is greatly reduced. After the solder has been melted and violently agitated to flow throughout the reservoir or chamber within the end cap 16, it cools and solidifies very quickly upon termination of the application of heat to the end cap 16. The result is that relatively little heat is transmitted to the fuse body during this process.

The wire-like fusible element 14 may be formed of material having a degree of inherent resiliency whereby the end portions 30, after being initially bent over, are urged outwardly against the end walls 36 of the caps 16. However, as previously stated, with the use of the electrically conducting material 46, this is not necessary because the fuse link end portions 30 need not be in direct contact with the end cap end walls 36.

With reference to FIG. 4, it is to be observed that the reduced diameter of the cylindrical portion 42 relative to the cylindrical portion 40 provides a chamber which is defined, on one side, by the fuse body end surface 18 and that the remelted electrically conducting material 46′ is thus substantially prevented by the end surface 18 from being forced out of the chamber and between the first cylindrical portion 40 and the fuse body 12. Thus, undesirable loss of the material 46′ is substantially reduced.

The inner diameter of the sidewall or first cylindrical portion 40 of end cap 16 is preferably about the same size of the outer diameter of the end portion of the fuse body 12, so as to be positively retained thereon. To facilitate assembly, the end caps 16 are preferably heated prior to placement on the fuse body, with the subsequent shrinkage of the end caps 16 upon cooling causing them to strongly grip the fuse body. The hot end caps 16 also tend to melt the portions of the plastic body in contact therewith, so that the end caps adhere to the ends of the fuse body.

The first cylindrical portion 40 of the end cap 16 is sized so as to comply with previously existing standards, such as those established by the Society of Automotive Engineers. As is well known, the end caps 16 may be formed of brass, or a brass alloy and may be plated to prevent oxidation. End caps 16 are assembled to the outer end portion of the fuse body 12 by shifting the end caps axially of the fuse body, and the end caps 16 are preferably simultaneously placed on the fuse body 12.

Though the embodiment illustrated in FIGS. 1 through 4 is that of a fuse, it is contemplated that the novel end cap structure of the present invention be used with other suitable electrically conducting components which are encapsulated by a material, e.g., resistors, capacitors, transistors, and the like. With such other electrically conducting components, the body material need not necessarily be a thermoplastic material but may be glass, ceramic, or other material as the case may be. Further, though the end caps are illustrated as having a cylindrical first portion and sidewall, other end cap shapes, as well as other component body shapes, may be used and the end cap sidewall may or may not compressively embrace the body.

From the foregoing, it will be observed that numerous variations and modifications may be effected without departing from the true spirit and scope of the novel concept of the invention. It is to be understood that no limitation with respect to the specific apparatus illustrated herein is intended or should be inferred. It is, of course, intended to cover by the appended claims all such modifications as fall within the scope of the claims.

What is claimed is:

1. An encapsulated electrically conducting component comprising:

a body defining a body sidewall and oppositely facing body ends;

a conductor extending through said body, said conductor being in the form of an elongate wire-like element having its midportion within said body and in surface-to-surface contact therewith, said conductor having opposite end portions each extending outwardly beyond one end of said body, said end portions being positioned at an angle with respect to the length of said element, so as to be disposed adjacent the respective body ends, each said end portion terminating within the periphery of said body; and an electrically conductive end cap positioned over each end portion of said body, said end caps each including a sidewall adjacent the sidewall of the body at one end thereof and including an end wall adjacent an end of the body, each said end cap further having an abutment means displaced inwardly of said cap end wall and abutting a portion of the surface of one of said oppositely facing body ends for maintaining the end wall thereof at a predetermined distance from said body end thereby preventing accidental severance of said angled end portion of said element during application of said end cap to said body end and for thereby defining a chamber for receiving said angled end portion of said wire-like element.

2. The component in accordance with claim 1 in which said body is cylindrical and in which each of said end caps is a cylindrical cup-like member and in which said cap sidewall compressively embraces the sidewall of the body adjacent one end thereof.

3. The component in accordance with claim 2 in which said sidewalls of said end caps further have smooth internal surfaces to permit said end caps to be assembled to said body by axial relative movement therebetween, said internal surfaces being in intimate surface-to-surface contact with the adjacent external surface of said body.

4. The component in accordance with claim 2 in which said abutment means is a generally annular shoulder extending inwardly from said end cap sidewall adjacent said body end.

5. The component in accordance with claim 1 in which said chambers contain a eutectic metal alloy.

6. The component in accordance with claim 1 in which said end portion of said wire-like element is positioned at substantially a right angle with respect to the length of said element within said body.

7. The component in accordance with claim 1 in which said body ends are generally perpendicular to said body sidewall and generally parallel to the end wall of the adjacent end cap.

8. The component in accordance with claim 1 further including an electrically conductive material within the chamber of said end cap and in contact with said angled end portions and said end cap end walls.

9. An electric fuse comprising:

a body defining a body sidewall and oppositely facing body ends;

a low melting point metal fusible link extending through said body, said link being in the form of an elongate wire-like element having its midportion within said body and in surface-to-surface contact therewith, said conductor having opposite end portions each extending outwardly beyond one end of said body, said end portions being positioned at an angle with respect to the length of said element so as to be disposed adjacent the respective body ends; and an electrically conductive end cap positioned over each end portion of said body, said end cap having a cylindrical first portion and a cylindrical second portion with a diameter less than said first portion and joined to the first portion by an annular shoulder, said end cap further including an end wall at one end of said cylindrical second portion, the inside surface of said first cylindrical portion being positioned adjacent to the sidewall of the body at one end thereof, with said end wall being disposed adjacent an end of the fuse body and with said annular shoulder bearing against the fuse body end in direct contact therewith, whereby severance of the end portion of the fusible link by the end cap end wall is prevented by the annular shoulder which serves to maintain the end wall at a predetermined distance from said fuse body end, the internal volume of said cylindrical second portion defining a chamber for receiving and enclosing therewith all of said end portion of said wire-like element.

10. The fuse in accordance with claim 9 in which said wire-like element is centered relative to said body.

11. The fuse in accordance with claim 9 wherein said wire-like element is of circular cross-sectional configuration.

12. The fuse in accordance with claim 9 in which said wire-like element has a uniform cross-sectional configuration throughout its length.

13. The fuse in accordance with claim 9 in which said wire-like element is formed of a material having a degree of inherent resiliency whereby said element end portions are urged against the end walls of said caps.

14. The fuse in accordance with claim 9 wherein said body has a ring-like gripping handle projecting from the external surface thereof at approximately the midpoint thereof.

15. The fuse in accordance with claim 9 in which said cylindrical first portion has a smooth internal surface to permit said end caps to be assembled to said body by axial relative movement therebetween and in which said internal surfaces are in intimate surface-to-surface contact with the adjacent external surface of the fuse body.

16. The fuse in accordance with claim 9 in which said wire-like element is a low-melting point metal alloy.

17. The fuse in accordance with claim 9 in which said end caps are metal.

18. The component in accordance with claim 9 further including an electrically conductive material within the chamber of said end cap and in contact with said angled end portions and said end cap end walls.

19. The fuse in accordance with claim 9 in which said body comprises a solid unitary body of transparent thermoplastic material.

20. The fuse in accordance with claim 19 in which the external surface of the portion of said wire-like element extending through said body is in intimate contact with said thermoplastic material.

21. In an electrically conducting component having a body defining a body sidewall and oppositely facing body ends and having a conductor element having at least one end portion extending outwardly beyond one end of said body, the method of applying an electrically conductive end cap to said component comprising:

providing an electrically conductive end cap including a sidewall and an end wall, said end cap having an abutment means displaced inwardly of said end cap end wall for maintaining the end wall outwardly of said abutment means to define a chamber for receiving said conductor end portion and for receiving a mixture of solder and flux;

providing a mixture of solder and flux at an elevated temperature in liquid form in said chamber of said end cap to at least partially fill said chamber;

cooling said mixture of solder and flux within said chamber whereby some of said flux forms a layer on the surface of the solder deposit within the end cap;

applying said end cap to one of said body ends with said abutment means bearing against said body end in direct contact therewith and with said conductor end portion disposed within said chamber; and applying sufficient heat to said end cap to remelt said solder and said flux whereby said flux is violently agitated against the conductor end portion so that it cleans and coats the end portion and so that the solder is violently agitated and flows throughout the chamber to bond said conductor end portion to said end cap.

22. The method in accordance with claim 21 in which said step of providing a mixture of solder and flux includes depositing a solid charge of flux core solder cap.

23. The method in accordance with claim 21 in which the step of applying said end cap to said body end includes compressively holding said end cap against the body end during the step of applying heat to the end cap.

24. The method in accordance with claim 21 in which the step of depositing said solder and said flux in said chamber includes depositing a sufficient amount of solder and flux to fill about 85% of the volume of the chamber.

25. The method in accordance with claim 21 in which said step of applying heat to said end cap includes applying heat by means of resistance heating to an exterior surface of the end cap.

26. The method in accordance with claim 21 in which said step of depositing solder and flux includes maintaining said end cap in a generally vertical position with said end wall lower than the other portion of the end cap.

27. The method in accordance with claim 21 in which said mixture of solder and flux has a post-deposition remelting point temperature less than the melting point temperature of said conductor end portion and in which said step of applying heat includes maintaining the temperature of the remelted solder and flux at more than 80° F. below the melting point temperature of said conductor end portion.

28. An encapsulated electrically conducting component comprising:

a cylindrical body defining a body sidewall and oppositely facing body ends;

a conductor extending through said body, said conductor being in the form of an elongate wire-like element having its midportion within said body and in surface-to-surface contact therewith, said conductor having opposite end portions each extending outwardly beyond one end of said body, said end portions being positioned at an angle with respect to the length of said element so as to be disposed adjacent the respective body ends; and an electrically conductive end cap positioned over each end portion of said body, said end caps each being a cylindrical cup-like member including a sidewall adjacent and compressively embracing the sidewall of the body at one end thereof and including an end wall adjacent an end of the body, said sidewalls of said end caps further have smooth internal surfaces to permit said end caps to be assembled to said body by axial relative movement therebetween, said internal surfaces being in intimate surface-to-surface contact with the adjacent external surface of said body, each said end cap further having an abutment means displaced inwardly of said cap end wall and abutting a portion of the surface of one of said oppositely facing body ends for maintaining the end wall thereof at a predetermined distance from said body end thereby preventing accidental severance of said angled end portion of said element during application of said end cap to said body end and for thereby defining a chamber for receiving said angled end portion of said wire-like element.

29. An encapsulated electrically conducting component comprising:

a body defining a body sidewall and oppositely facing body ends;

a conductor extending through said body, said conductor being in the form of an elongate wire-like element having its midportion within said body and in surface-to-surface contact therewith, said conductor having opposite end portions each extending outwardly beyond one end of said body, said end portions being positioned at an angle with respect to the length of said element so as to be disposed adjacent the respective body ends;

an electrically conductive end cap positioned over each end portion of said body, said end caps each including a sidewall adjacent the sidewall of the body at one end thereof and including an end wall adjacent an end of the body, each said end cap further having an abutment means displaced inwardly of said cap end wall and abutting a portion of the surface of one of said oppositely facing body ends for maintaining the end wall thereof at a predetermined distance from said body end thereby preventing accidental severance of said angled end portion of said element during application of said end cap to said body end, each said end cap and one of said body ends defining a chamber enclosing one of said angled end portions of said wire-like element; and an electrically conductive material within said chambers and in contact with both said angled end portions and said end cap end walls.

* * * * *